US010529342B2

(12) United States Patent
Beack et al.

(10) Patent No.: US 10,529,342 B2
(45) Date of Patent: Jan. 7, 2020

(54) METHOD FOR ENCODING MULTI-CHANNEL AUDIO SIGNAL AND ENCODING DEVICE FOR PERFORMING ENCODING METHOD, AND METHOD FOR DECODING MULTI-CHANNEL AUDIO SIGNAL AND DECODING DEVICE FOR PERFORMING DECODING METHOD

(71) Applicant: Electronics and Telecommunications Research Institute, Daejeon (KR)

(72) Inventors: Seung Kwon Beack, Daejeon (KR); Jeong Il Seo, Daejeon (KR); Jong Mo Sung, Daejeon (KR); Tae Jin Lee, Daejeon (KR); Jin Soo Choi, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 15/540,800

(22) PCT Filed: Dec. 31, 2015

(86) PCT No.: PCT/KR2015/014543

§ 371 (c)(1),
(2) Date: Jun. 29, 2017

(87) PCT Pub. No.: WO2016/108655

PCT Pub. Date: Jul. 7, 2016

(65) Prior Publication Data

US 2018/0005635 A1 Jan. 4, 2018

(30) Foreign Application Priority Data

Dec. 31, 2014 (KR) ..... 10-2014-0195783
Dec. 30, 2015 (KR) ..... 10-2015-0190159

(51) Int. Cl.
*G10L 19/008* (2013.01)
*H04S 3/00* (2006.01)
*G10L 19/24* (2013.01)

(52) U.S. Cl.
CPC ..... *G10L 19/008* (2013.01); *G10L 19/24* (2013.01); *H04S 3/008* (2013.01); *H04S 2400/01* (2013.01); *H04S 2400/03* (2013.01)

(58) Field of Classification Search
CPC ..... G10L 19/008; G10L 19/24; G10L 19/22; H04S 3/008; H04S 2400/01; H04S 2400/03
See application file for complete search history.

(56) References Cited

U.S. PATENT DOCUMENTS 8,027,479 B2 * 9/2011 Villemoes ..... G10L 19/008 381/22
8,583,424 B2 * 11/2013 Jaillet ..... G10L 19/008 704/201

(Continued)

FOREIGN PATENT DOCUMENTS

KR 1020100007739 A 1/2010
KR 1020110044693 A 4/2011

(Continued)

OTHER PUBLICATIONS

Breebaart, Jeroen et al., Binaural Rendering in MPEG Surround, EURASIP Journal on Advances in Signal Processing, vol. 2008, Article ID 732895, pp. 1-14, Jan. 2, 2008, Hindawi Publishing Corporation.

(Continued)

*Primary Examiner* — Jason R Kurr
(74) *Attorney, Agent, or Firm* — William Park & Associates Ltd.

(57) ABSTRACT

An encoding method for a multi-channel audio signal, an encoding apparatus for performing the encoding method, (Continued)

and a decoding method for a multi-channel audio signal and a decoding apparatus for performing the decoding method are disclosed. A method and apparatus of bypassing an MPEG Surround (MPS) standard operation and using an arbitrary tree when a number of audio signals of N channels exceeds a channel number defined in an MPS standard, is disclosed.

6 Claims, 9 Drawing Sheets

(56) References Cited

U.S. PATENT DOCUMENTS

| | | | | |
|---|---|---|---|---|
| 9,009,057 | B2 * | 4/2015 | Breebaart | H04S 3/004 704/500 |
| 2007/0078550 | A1 | 4/2007 | Pang et al. | |
| 2011/0119055 | A1 * | 5/2011 | Lee | G10L 19/008 704/205 |
| 2012/0002818 | A1 * | 1/2012 | Heiko | G10L 19/008 381/22 |
| 2012/0209600 | A1 * | 8/2012 | Kim | G10L 19/025 704/219 |
| 2012/0253797 | A1 * | 10/2012 | Geiger | G10L 19/083 704/219 |
| 2013/0066640 | A1 | 3/2013 | Grill et al. | |

FOREIGN PATENT DOCUMENTS

| | | | |
|---|---|---|---|
| WO | 2007110823 | A1 | 10/2007 |
| WO | 2014168439 | A1 | 10/2014 |
| WO | 2014171791 | A1 | 10/2014 |

OTHER PUBLICATIONS

Breebaart, Jeroen et al., MPEG Spatial Audio Coding / MPEG Surround: Overview and Current Status, Audio Engineering Society Convention Paper, Oct. 7-10, 2005, New York, New York, USA.

Herre, Jurgen et al., MPEG Surround—The ISO/MPEG Standard for Efficient and Compatible Multi-Channel Audio Coding, Audio Engineering Society Convention Paper, May 5-8, 2007, Vienna, Austria.

* cited by examiner

METHOD FOR ENCODING MULTI-CHANNEL AUDIO SIGNAL AND ENCODING DEVICE FOR PERFORMING ENCODING METHOD, AND METHOD FOR DECODING MULTI-CHANNEL AUDIO SIGNAL AND DECODING DEVICE FOR PERFORMING DECODING METHOD

TECHNICAL FIELD

Example embodiments relate to an encoding method for a multi-channel audio signal and an encoder to perform the encoding method, and a decoding method for a multi-channel audio signal and a decoder to perform the decoding method, and more particularly, to a method and apparatus for performing compression without deterioration in sound quality even when a number of channels increases.

BACKGROUND ART

MPEG Surround (MPS) is an audio codec for coding a multi-channel audio, such as a 5.1 channel and a 7.1 channel. The MPS may compress and transmit a multi-channel audio signal at a high compression ratio.

Only, MPS has a constraint of backward compatibility in encoding and decoding processes. Thus, a bit stream of the multi-channel audio signal via MPS requires the backward compatibility that the bitstream is reproduced in a mono or stereo format even with a previous audio codec.

Accordingly, even though a number of channels of the multi-channel audio signal to be input to the MPS increases, a finally output and transmitted audio signal needs to be represented in mono or stereo. A decoder may reconstruct the multi-channel audio signal from an audio bit stream using additional information received from an encoder. Here, the decoder may reconstruct the multi-channel audio signal based on the additional information for upmixing.

However, a communication environment is improved in recent years and a transmission bandwidth is increased such that a bandwidth allocated to the audio signal is also increased. Accordingly, technology has been improved in a direction of maintaining an original sound quality of the multi-channel audio signal more than of excessively compressing the multi-channel audio signal to correspond to the bandwidth. Nevertheless, compression is still required to process the multi-channel audio signal having a large number of channels.

Thus, even though the number of channels increases, a method of reducing and transmitting a volume of data through compression greater than or equal to a predetermined level while maintaining a quality of the multi-channel audio signal is required.

DISCLOSURE OF INVENTION

Technical Goals

Example embodiments provide a method and apparatus for processing multi-channel audio signals of N channels using an arbitrary tree and bypassing an MPEG Surround (MPS) standard operation when a number of the multi-channel audio signals of the N channels exceeds a channel number defined by an MPS standard.

Technical Solutions

According to an aspect of the present invention, there is provided an encoding method for a multi-channel audio signal, the method including generating audio signals of N/2 channels by downmixing audio signals of N channels using an MPEG Surround (MPS) encoder, and performing encoding with respect to a core band of the audio signals of the N/2 channels using a Unified Speech and Audio Codec (USAC) encoder.

The generating of the audio signals of the N/2 channels may include generating the audio signals of the N/2 channels by downmixing the audio signals of the N channels using N/2 two-to-one (TTO) coding modules.

The encoding method may further include converting a sampling rate with respect to an audio signal using a sampling rate converter, wherein the sampling rate converter is disposed before the MPS encoder to convert a sampling rate of the audio signals of the N channels, or disposed after the MPS encoder to convert a sampling rate of the audio signals of the N/2 channels.

The converting of the sampling rate may include converting the sampling rate with respect to the audio signal according to a bit rate to be applied to the USAC encoder.

The generating of the audio signals of the N/2 channels may include generating the audio signals of the N/2 channels by downmixing the audio signals of the N channels using an arbitrary tree when a number of the N channels exceeds a channel number defined by an MPS standard.

The generating of the audio signals of the N/2 channels may include bypassing an MPS standard operation to be performed by the MPS encoder and downmixing the audio signals of the N channels using an arbitrary tree when a number of the N channels exceeds a channel number defined by an MPS standard.

According to another aspect of the present invention, there is provided a decoding method for a multi-channel audio signal, the method including performing decoding with respect to a core band of audio signals of N/2 channels using a Unified Speech and Audio Codec (USAC) decoder, and generating audio signals of N channels by upmixing the audio signals of the N/2 channels using an MPEG Surround (MPS) decoder.

The generating of the audio signals of the N channels may include generating of the audio signals of the N channels by upmixing the audio signals of the N/2 channels using N/2 One-To-Two (OTT) coding modules.

The decoding method may further include converting a sampling rate with respect to an audio signal using a sampling rate converter, wherein the sampling rate converter is disposed before the MPS decoder to convert a sampling rate of the audio signals of the N/2 channels, or disposed after the MPS decoder to convert a sampling rate of the audio signals of the N channels.

The converting of the sampling rate may include converting the sampling rate of the audio signal according to a bit rate to be applied to the USAC decoder.

The generating of the audio signals of the N channels may include generating the audio signals of the N channels by upmixing the audio signals of the N/2 channels using an arbitrary tree when a number of the N/2 channels exceeds a channel number defined by an MPS standard.

The generating of the audio signals of the N channels may include bypassing an MPS standard operation supported by an MPS encoder and upmixing the audio signals of the N/2 channels using an arbitrary tree when a number of the N/2 channels exceeds a channel number defined by an MPS standard.

According to still another aspect of the present invention, there is provided an encoding apparatus for a multi-channel audio signal, the apparatus including an MPEG Surround (MPS) encoder configured to generate audio signals of N/2 channels by downmixing audio signals of N channels, and a Unified Speech and Audio Codec (USAC) encoder configured to perform encoding with respect to a core band of the audio signals of the N/2 channels using the USAC encoder.

The encoding apparatus may further include a sampling rate converter configured to convert a sampling rate of an audio signal, wherein the sampling rate converter is disposed before the MPS encoder to convert a sampling rate of the audio signals of the N channels, or disposed after the MPS encoder to convert a sampling rate of the audio signals of the N/2 channels.

The MPS encoder may be configured to generate the audio signals of the N/2 channels by downmixing the audio signals of the N channels using an arbitrary tree when a number of the N channels exceeds a channel number defined by an MPS standard.

The MPS encoder may be configured to bypass an MPS standard operation supported by the MPS encoder and downmix the audio signals of the N channels using an arbitrary tree when a number of the N channels exceeds a channel number defined by an MPS standard.

According to a further aspect of the present invention, there is provided a decoding apparatus for a multi-channel audio signal, the apparatus including a Unified Speech and Audio Codec (USAC) decoder configured to perform decoding with respect to a core band of audio signals of N/2 channels, and an MPEG Surround (MPS) decoder configured to generate audio signals of N channels by upmixing the audio signals of the N/2 channels.

The MPS decoder may be configured to generate the audio signals of the N channels by upmixing the audio signals of the N/2 channels using N/2 one-to-two (OTT) coding modules.

The decoding apparatus may further include a sampling rate converter configured to convert a sampling rate of an audio signal, wherein the sampling rate converter is disposed before the MPS decoder to convert a sampling rate of the audio signals of the N/2 channels, or disposed after the MPS decoder to convert a sampling rate of the audio signals of the N channels.

The MPS decoder may be configured to generate the audio signals of the N channels by bypassing an MPS standard operation supported by an MPS encoder and upmixing the audio signals of the N/2 channels using an arbitrary tree when a number of the N/2 channels exceeds a channel number defined by an MPS standard.

Effects

According to example embodiments, it is possible to process multi-channel audio signals of N channels using an arbitrary tree by bypassing an MPEG Surround (MPS) standard operation when a number of the multi-channel audio signals of the N channels exceeds a channel number defined by an MPS standard.

BEST MODE FOR CARRYING OUT THE INVENTION

Hereinafter, embodiments will be described with reference to the accompanying drawings.

Figure 1:
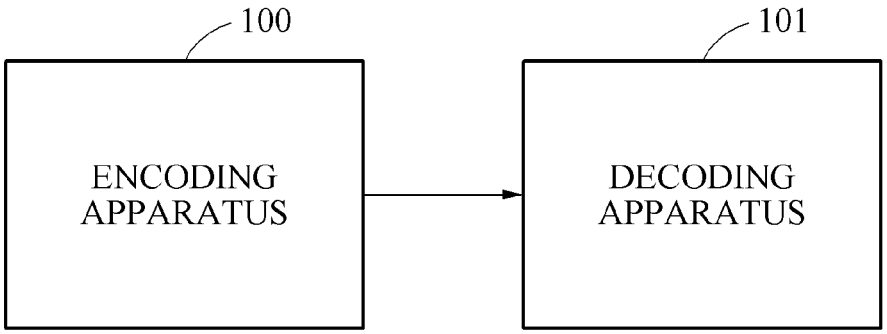
FIG. 1 is a block diagram illustrating an encoding apparatus and a decoding apparatus according to an example embodiment.

FIG. 1 is a block diagram illustrating an encoding apparatus and a decoding apparatus according to an example embodiment.

An encoding apparatus 100 may generate N/2 channel signals by downmixing N channel signals. Subsequently, the encoding apparatus 100 may generate one channel signal (mono), two channel signals (stereo), or M channel signals (multi-channel) by encoding N/2 channel signals.

Accordingly, a decoding apparatus 101 may generate the N/2 channel signals using the one channel signal (mono), the two channel signals (stereo), or the M channel signals (multi-channel) generated in the encoding apparatus 100, and then generate the N channel signals by upmixing the N/2 channel signals. Here, N of the N/2 channel signals may be greater than or equal to 10.

Figure 2:
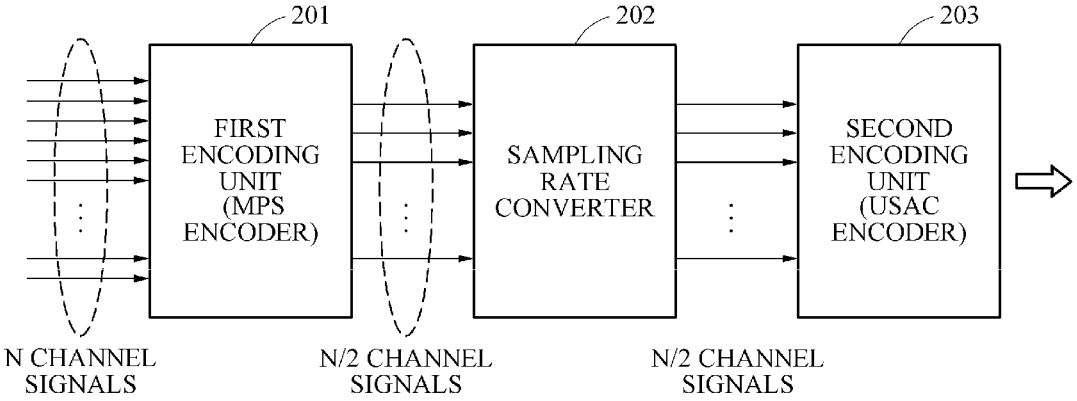
FIG. 2 illustrates an example of a configuration of an encoding apparatus according to an example embodiment.

FIG. 2 illustrates an example of a configuration of an encoding apparatus according to an example embodiment.

Referring to FIG. 2, an encoding apparatus includes a first encoding unit 201, a sampling rate converter 202, and a second encoding unit 203. The first coding unit 201 is defined as an MPEG Surround (MPS) encoder. In addition, the second encoding unit 203 is defined as a unified speech and audio codec (USAC) encoder. Concisely, audio signals of N/2 channels may be generated by downmixing audio signals of N channels.

Accordingly, the sampling rate converter 202 may convert a sampling rate of the audio signals of the N/2 channels. The sampling rate converter 202 may perform downsampling based on a bit rate allocated to the USAC encoder which is the second encoding unit 203. When a sufficiently high bit rate is allocated to the USAC encoder which is the second encoding unit 203, the sampling rate converter 202 may be bypassed.

Subsequently, the second encoding unit 203 may perform encoding on a core band of the audio signals of the N/2 channels in which a sampling rate is converted. Accordingly, audio signals of M channels may be output using the second encoding unit 203.

A downmix signal output using a conventional MPS encoder is limited to 1 channel, 2 channel, and 5.1 channel. However, the first encoding unit 201 may downmixing the audio signals of the N channels and then output the audio signals of the N/2 channels which are a result of the downmixing. Here, since the audio signals of the N/2 channels are greater than or equal to a minimum 5.1 channel, N may be greater than or equal to 10.2 channel.

Figure 3:
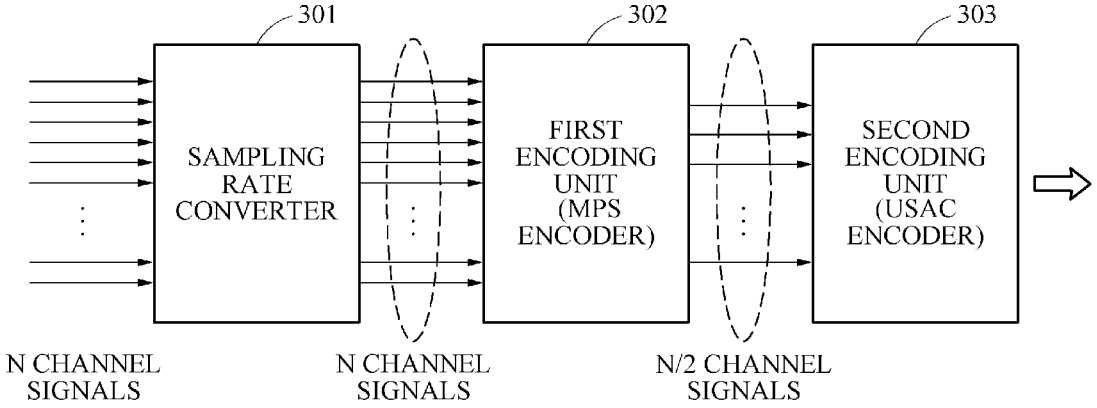
FIG. 3 illustrates another example of detailed constituent components of an encoding apparatus according to an example embodiment.

FIG. 3 illustrates another example of detailed constituent components of an encoding apparatus according to an example embodiment.

Even though FIG. 3 illustrates identical constituent components of FIG. 2, an order of the constituent components is changed. In detail, FIG. 2 illustrates an example in which the sampling rate converter 202 exists between the first encoding unit 201 and the second encoding unit 203. However, FIG. 3 illustrates an example in which a first encoding unit 302 and a second encoding unit 303 are disposed after a sampling rate converter 301.

Figure 4:
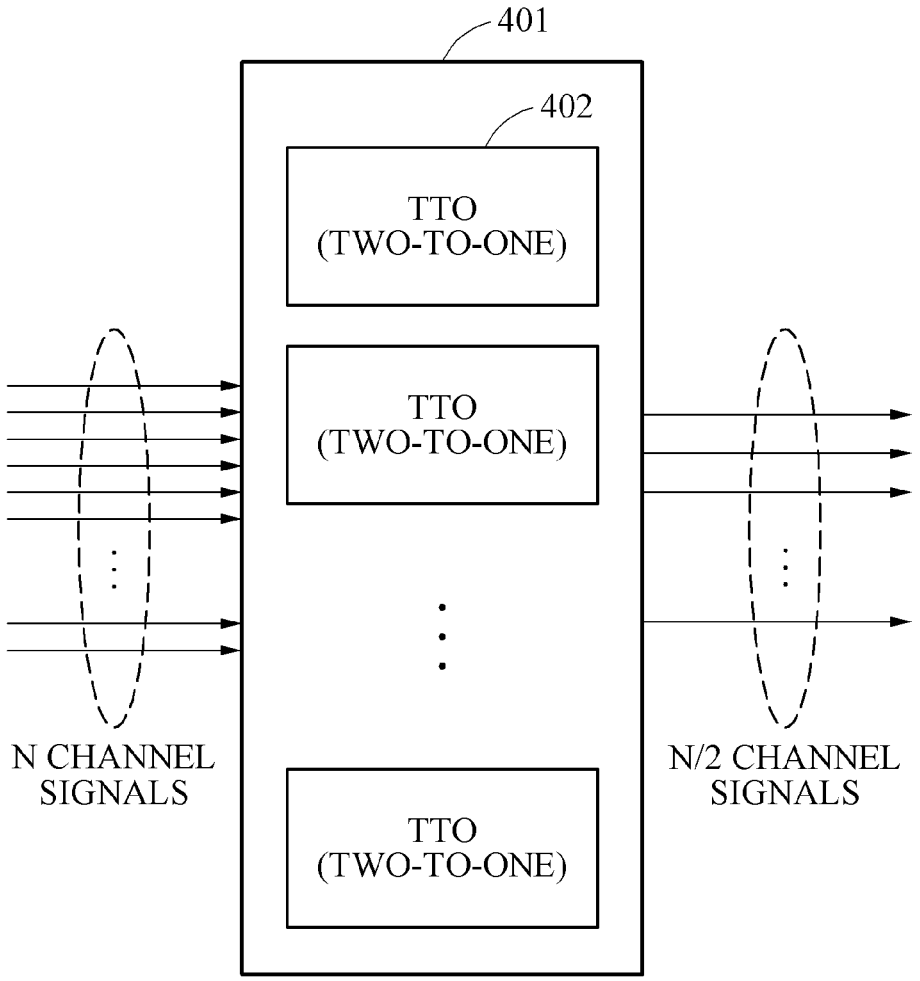
FIG. 4 illustrates an operation of a first encoding unit according to an example embodiment.

FIG. 4 illustrates an operation of a first encoding unit according to an example embodiment.

Referring to FIG. 4, a first encoding unit 401 may include a plurality of two-to-one (TTO) modules 402. Here, each of the plurality of TTO modules 402 may output an audio signal of one channel by downmixing audio signals of two channels. The first encoding unit 401 may include N/2 TTO modules 402 to output audio signals of N/2 channels by downmixing audio signals of N channels input as illustrated in FIG. 4.

When the first encoding unit 401 follows a conventional MPS standard, audio signals output using the first encoding unit 401 may include two channels and 5.1 channels. However, according to an example embodiment, the first encoding unit 401 may output the audio signals of the N/2 channels according to the MPS from the audio signals of the N channels. Here, the first encoding unit 401 may need to consider an additional syntax for controlling an MPEG Surround (MPS). In an example, the first encoding unit 401 may define the additional syntax for controlling the MPS utilizing a coding mode that uses an arbitrary tree.

Figure 5:
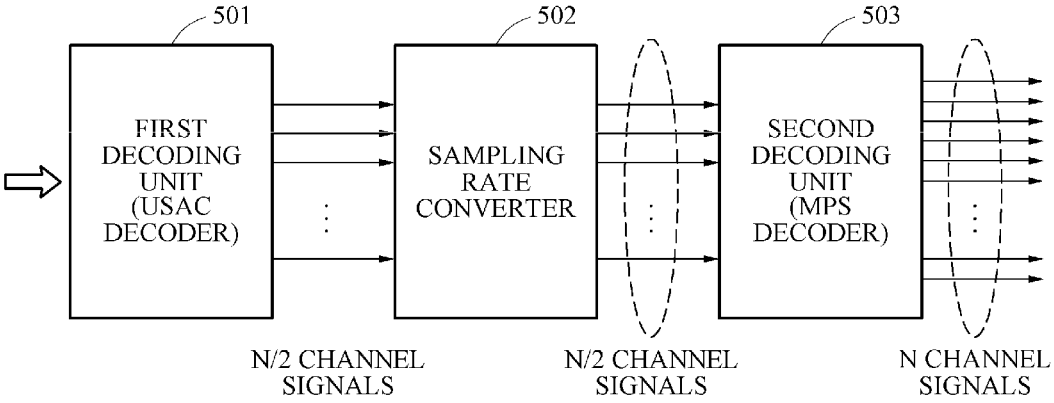
FIG. 5 illustrates an example of a configuration of a decoding apparatus according to an example embodiment.

FIG. 5 illustrates an example of a configuration of a decoding apparatus according to an example embodiment.

Referring to FIG. 5, a decoding apparatus includes a first decoding unit 501, a sampling rate converter 502, and a second decoding unit 503. The first decoding unit 501 may output audio signals of N/2 channels from audio signals of M channels. Here, the first decoding unit 501 may be defined as a Unified Speech and Audio Codec (USAC) decoder.

In addition, the sampling rate converter 502 may convert a sampling rate of the audio signals of the N/2 channels. Here, the sampling rate converter 502 may convert the converted sampling rate of the audio signal in an encoding apparatus into an original sampling rate. That is, when the conversion is performed on a sampling rate in FIG. 2 or FIG. 3, the sampling rate converter 502 operates. When the conversion is not performed on a sampling rate in FIG. 2 or FIG. 3, the sampling rate converter 502 does not operate and may be bypassed.

Meanwhile, the second decoding unit 503 may output the audio signals of the N/2 channels by upmixing the audio signals of the N/2 channels output from the sampling rate converter 502.

A downmix signal to be input to a conventional MPS decoder may be limited to 1 channel, 2 channel, and 5.1 channel. However, the second decoding unit 201 may output the audio signals of the N/2 channels and then output the audio signals of the N channels which are a result of the upmixing. Here, since the audio signals of the N/2 channels input to the second decoding unit 503 are greater than or equal to a minimum 5.1 channel, N may be greater than or equal to 10.2 channel.

Figure 6:
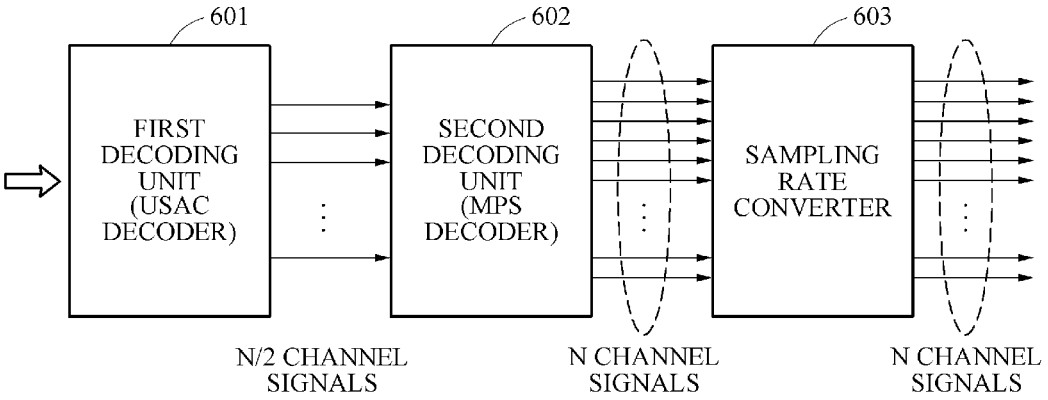
FIG. 6 illustrates another example of a configuration of a decoding apparatus according to an example embodiment.

FIG. 6 illustrates another example of a configuration of a decoding apparatus according to an example embodiment.

Unlike FIG. 5, FIG. 6 may process audio signals in an order of a first decoding unit 601, a second decoding unit 602, and a sampling rate converter 603. The first decoding unit 601 may output audio signals of N/2 channels by decoding audio signals of M channels. Accordingly, the second decoding unit 602 may output audio signals of N channels by upmixing the audio signals of the N/2 channels. Subsequently, the sampling rate converter 603 may convert a sampling rate of the audio signals of the N channels output using the second decoding unit 602.

The first decoding unit 601 corresponds to USAC (Unified Speech and Audio Codec) decoder. And, the second decoding unit 602 corresponds to MPS (MPEG Surround) decoder. The first decoding unit 601 performs joint stereo coding based MDCT Domain with Complex Stereo Prediction. And, the second decoding unit 602 is working QMF domain based 2-1-2 stereo tool with the possibility of using residual coding.

The second decoding unit 602 performs processing the audio signal based on a structure for the N-N/2-N system is outlined. For this configuration, N/2 is identical to the number of downmix signals (NumInCh=N/2). In the other words, N/2 is number of channels. Therefore, the number of output signals (i.e., N) of the second decoding unit 602 is an even number in order to process N/2 downmix signals, since the number of OTT boxes is equal to N/2. A maximum number of N/2 decorrelators is used when LFE channels are not included in audio signals of N channels outputted from the second decoding unit 602. However, if the number of channels outputted from the second decoding unit 602 exceeds twenty channels, the de-correlation filters are reused.

The outputs of the decorrelators are replaced by residual signals for predetermined frequency regions, depending on the bitstream. No decorrelation is used for the case of OTT based upmix when a LFE channel is one output of the OTT box. No residual signal can be inserted for these OTT boxes.

The multi-channel reconstruction for the N-N/2-N configuration is visualized by means of a tree-structure. In this configuration, all the OTT boxes represent parallel processing stages and no OTT box can be connected with any other OTT boxes. The every OTT box included in the second decoding unit 602 creates the audio signals of two channels based on the audio signals of one channel, the corresponding CLD and ICC parameters, and residual signal. So, the second decoding unit 602 generates the audio signal of N channels by using the N/2 OTT boxes.

In FIG. 6, the decoding apparatus performs QCE (Quad Channel Element) mode. The Quad Channel Element (QCE) is a method for joint coding of four channels for more efficient coding of horizontally and vertically distributed channels. A QCE consists of two consecutive CPEs and is formed by hierarchically combining the Joint Stereo tool with possibility of Complex Stereo Prediction in horizontal direction and the MPEG Surround based stereo tool in vertical direction. This is achieved by enabling both stereo tools and swapping output channels between applying the tools. Stereo SBR is performed in horizontal direction to preserve the left-right relations of high frequencies. In the example, before applying Stereo SBR, the first channel and the second channel of the second decoding unit 602 is swapped to allow Stereo SBR.

Figure 7:
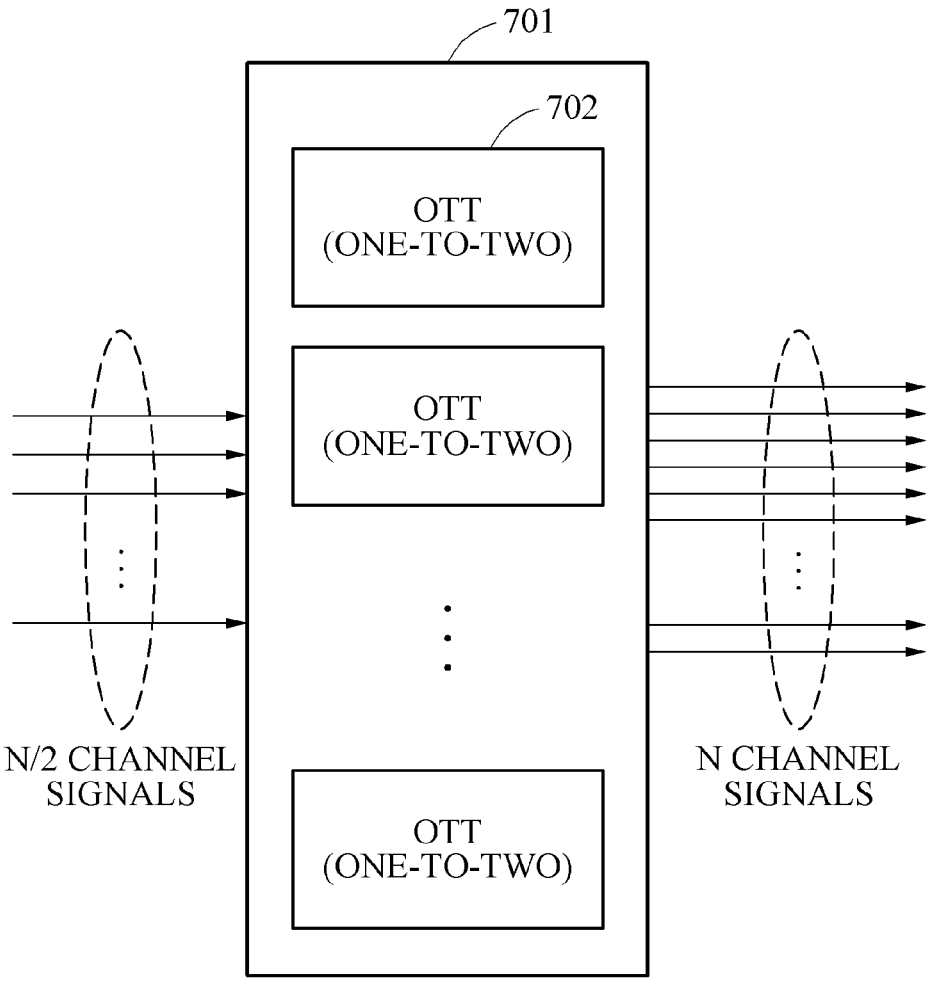
FIG. 7 illustrates an operation of a second decoding unit according to an example embodiment.

FIG. 7 illustrates an operation of a second decoding unit according to an example embodiment.

A second decoding unit 701 described with reference to FIGS. 5 and 6 may output audio signals of N channels by upmixing audio signals of N/2 channels. Here, the second decoding unit 701 may include a plurality of one-to-two (OTT) modules 702. The OTT modules 702 may output audio signals of two channels in a stereo format by upmixing an audio signal of one channel.

Accordingly, the second decoding unit 701 may include N/2 OTT modules 702 for outputting the audio signals of the N channels by upmixing the audio signals of the N/2 channels.

When the second decoding unit 701 follows a conventional MPEG Surround (MPS) standard, a downmixed audio signal to be input and processed in the second decoding unit 701 may only include one channel, two channels, and 5.1 channels. However, according to an example embodiment, the second decoding unit 701 may output the audio signals of the N channels according to a MPS from the audio signals of the N/2 channels. Here, N may be greater than or equal to 10.2.

Here, the second decoding unit 701 may need to consider an additional syntax for controlling the MPS. In an example, the second decoding unit 701 may define the additional syntax for controlling the MPS by utilizing a coding mode that uses an arbitrary tree.

Figure 8:
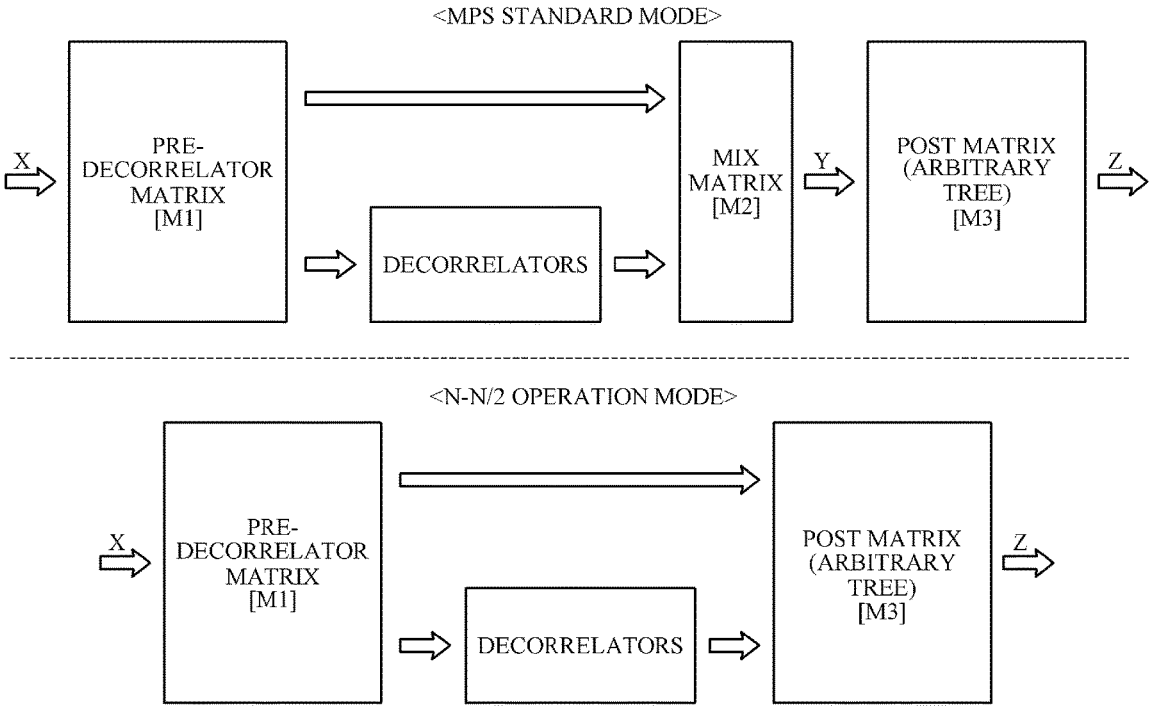
FIG. 8 illustrates a process of upmixing using an arbitrary tree according to an example embodiment.

FIG. 8 illustrates a process of upmixing using an arbitrary tree according to an example embodiment.

An example described with reference to FIG. 8 relates to the second decoding unit 503 of FIG. 5 and the second decoding unit 602 of FIG. 6 corresponding to an MPEG Surround (MPS) decoder.

A coding mode using an arbitrary tree operates based on a number of downmix signals which are an output of an MPS encoder. Table 1 represents an MPS input and output relationship defined by a current MPS standard. Table 1 represents ISO/IEC 23003-1 Table 40 (bsTreeConfig) which is an MPS standard. Table 2 represents a configuration of a downmix channel according to bsTreeConfig.

TABLE 1

| bsTreeConfig | Meaning |
|---|---|
| 0 | 5151 configuration |
| | numOttBoxes = 5 |
| | defaultCld[0] = 1 |
| | defaultCld[1] = 1 |
| | defaultCld[2] = 0 |
| | defaultCld[3] = 0 |
| | defaultCld[4] = 1 |
| | defaultCld[5] = 0 |
| | ottModeLfe[0] = 0 |
| | ottModeLfe[1] = 0 |
| | ottModeLfe[2] = 0 |
| | ottModeLfe[3] = 0 |
| | ottModeLfe[4] = 1 |
| | numTttBoxes = 0 |
| | numInChan = 1 |
| | numOutChan = 6 |
| | output channel ordering: L, R, C, LFE, Ls, Rs |
| 1 | 5152 configuration |
| | numOttBoxes = 5 |
| | defaultCld[0] = 1 |
| | defaultCld[1] = 0 |
| | defaultCld[2] = 1 |
| | defaultCld[3] = 1 |
| | defaultCld[4] = 1 |
| | defaultCld[5] = 0 |
| | ottModeLfe[0] = 0 |
| | ottModeLfe[1] = 0 |
| | ottModeLfe[2] = 1 |
| | ottModeLfe[3] = 0 |
| | ottModeLfe[4] = 0 |
| | numTttBoxes = 0 |
| | numInChan = 1 |
| | numOutChan = 6 |
| | output channel ordering: L, Ls, R, Rs, C, LFE |
| 2 | 525 configuration |

TABLE 1-continued

| bsTreeConfig | Meaning |
|---|---|
| | numOttBoxes = 3 |
| | defaultCld[0] = 1 |
| | defaultCld[1] = 1 |
| | defaultCld[2] = 1 |
| | defaultCld[3] = 1 |
| | defaultCld[4] = 0 |
| | defaultCld[5] = 1 |
| | defaultCld[6] = 0 |
| | defaultCld[7] = 0 |
| | defaultCld[8] = 0 |
| | ottModeLfe[0] = 1 |
| | ottModeLfe[1] = 0 |
| | ottModeLfe[2] = 0 |
| | numTttBoxes = 1 |
| | numInChan = 2 |
| | numOutChan = 6 |
| | output channel ordering: L, Ls, R, Rs, C, LFE |
| 3 | 7271 configuration (5/2.1) |
| | numOttBoxes = 5 |
| | defaultCld[0] = 1 |
| | defaultCld[1] = 1 |
| | defaultCld[2] = 1 |
| | defaultCld[3] = 1 |
| | defaultCld[4] = 1 |
| | defaultCld[5] = 1 |
| | defaultCld[6] = 0 |
| | defaultCld[7] = 1 |
| | defaultCld[8] = 0 |
| | defaultCld[9] = 0 |
| | defaultCld[10] = 0 |
| | ottModeLfe[0] = 1 |
| | ottModeLfe[1] = 0 |
| | ottModeLfe[2] = 0 |
| | ottModeLfe[3] = 0 |
| | ottModeLfe[4] = 0 |
| | numTttBoxes = 1 |
| | numInChan = 2 |
| | numOutChan = 8 |
| | output channel ordering: L, Lc, Ls, R, Rc, Rs, C, LFE |
| 4 | 7272 configuration (3/4.1) |
| | numOttBoxes = 5 |
| | defaultCld[0] = 1 |
| | defaultCld[1] = 1 |
| | defaultCld[2] = 1 |
| | defaultCld[3] = 1 |
| | defaultCld[4] = 1 |
| | defaultCld[5] = 1 |
| | defaultCld[6] = 0 |
| | defaultCld[7] = 1 |
| | defaultCld[8] = 0 |
| | defaultCld[9] = 0 |
| | defaultCld[10] = 0 |
| | ottModeLfe[0] = 1 |
| | ottModeLfe[1] = 0 |
| | ottModeLfe[2] = 0 |
| | ottModeLfe[3] = 0 |
| | ottModeLfe[4] = 0 |
| | numTttBoxes = 1 |
| | numInChan = 2 |
| | numOutChan = 8 |
| | output channel ordering: L, Lsr, Ls, R, Rsr, Rs, C, LFE |
| 5 | 7571 configuration (5/2.1) |
| | numOttBoxes = 2 |
| | defaultCld[0] = 1 |
| | defaultCld[1] = 1 |
| | defaultCld[2] = 0 |
| | defaultCld[3] = 0 |
| | defaultCld[4] = 0 |
| | defaultCld[5] = 0 |
| | defaultCld[6] = 0 |
| | defaultCld[7] = 0 |
| | ottModeLfe[0] = 0 |
| | ottModeLfe[1] = 0 |
| | numTttBoxes = 0 |
| | numInChan = 6 |
| | numOutChan = 8 |
| | output channel ordering: L, Lc, Ls, R, Rc, Rs, C, LFE |
| 6 | 7572 configuration (3/4.1) |

TABLE 1-continued

| bsTreeConfig | Meaning |
|---|---|
| | numOttBoxes = 2<br>defaultCld[0] = 1<br>defaultCld[1] = 1<br>defaultCld[2] = 0<br>defaultCld[3] = 0<br>defaultCld[4] = 0<br>defaultCld[5] = 0<br>defaultCld[6] = 0<br>defaultCld[7] = 0<br>ottModeLfe[0] = 0<br>ottModeLfe[1] = 0<br>numTttBoxes = 0<br>numInChan = 6<br>numOutChan = 8<br>output channel ordering: L, Lsr, Ls, R, Rsr, Rs, C, LFE |
| 7 . . . 15 | Reserved |

TABLE 2

| Configuration | bsTreeConfig | $Dch(ch_{outpt})$ |
|---|---|---|
| 5-1-5 | 0, 1 | $Dch(ch_{outpt}) = M_0$, if $ch_{output} \in \{L, Ls, C, R, Rs\}$ |
| 5-2-5 | 2 | $Dch(ch_{outpt}) = \begin{cases} C_0, \text{ if } ch_{output} \in \{C\} \\ L_0, \text{ if } ch_{output} \in \{L, Ls\} \\ R_0, \text{ if } ch_{output} \in \{R, Rs\} \end{cases}$ |
| $7\text{-}2\text{-}7_1$ | 3 | $Dch(ch_{outpt}) = \begin{cases} C_0, \text{ if } ch_{output} \in \{C\} \\ L_0, \text{ if } ch_{output} \in \{L, Lc, Ls\} \\ R_0, \text{ if } ch_{output} \in \{R, Rc, Rs\} \end{cases}$ |
| $7\text{-}2\text{-}7_2$ | 4 | $Dch(ch_{outpt}) = \begin{cases} C_0, \text{ if } ch_{output} \in \{C\} \\ L_0, \text{ if } ch_{output} \in \{L, Lsr, Ls\} \\ R_0, \text{ if } ch_{output} \in \{R, Rsr, Rs\} \end{cases}$ |
| $7\text{-}5\text{-}7_1$ | 5 | $Dch(ch_{outpt}) = \begin{cases} L_0, \text{ if } ch_{output} \in \{L, Lc\} \\ R_0, \text{ if } ch_{output} \in \{R, Rc\} \end{cases}$ |
| $7\text{-}5\text{-}7_2$ | 6 | $Dch(ch_{outpt}) = \begin{cases} Ls_0, \text{ if } ch_{output} \in \{Lsr, Ls\} \\ Rs_0, \text{ if } ch_{output} \in \{Rsr, Rs\} \end{cases}$ |

BsTreeConfig is a syntax that defines the MPS input and output relationship. A decoding process of a signal output from the MPS encoder and a signal input to the MPS encoder according to BsTreeConfig is defined. When BsTreeConfig is 0, the MPS encoder may receive audio signals of six channels (5.1) and output a downmix signal of one channel. Accordingly, the MPS decoder may restore the audio signals of the six channels again by upmixing the downmix signal of the one channel.

Thus, the MPS decoder requires five one-to-two (OTT) modules. In addition, a channel level difference (CLD) which is a parameter for upmixing may be required for each of the OTT modules. Here, in the CLD, flags of defaultCLD [0~5] are defined according to the OTT modules. Here, an identification number of defaultCLD corresponds to a position of an OTT module. When defaultCLD of an OTT module is 1, the CLD is enabled. Also, such as CLD, ottModeLfe is used as the parameter for upmixing and ottModeLfe is a flag used when Lfe is present in an input channel.

Since the flags of defaultCLD[0~5] are defined by the MPS standard, maximum six OTT modules are usable. Accordingly, the current MPS standard does not satisfy an example in which a number of channels input to the MPS encoder is more than or equal to 10 channels and an audio signal is transmitted as a downmix signal.

TABLE 3

| BsTreeConfig | Meaning |
|---|---|
| reserved | 12-12 configuration<br>[N(DMX) − N(output)]<br>numOttBoxes = 0<br>defaultCld[0] = 0<br>defaultCld[1] = 0<br>defaultCld[2] = 0<br>defaultCld[3] = 0<br>defaultCld[4] = 0<br>defaultCld[5] = 0<br>ottModeLfe[0] = 0<br>ottModeLfe[1] = 0<br>ottModeLfe[2] = 0<br>ottModeLfe[3] = 0<br>ottModeLfe[4] = 0<br>numTttBoxes = 0<br>numInChan = 12<br>numOutChan = 12 |

However, according to an example embodiment, a case in which the number of channels is more than or equal to ten channels may be expressed using a reserved bit defined by the MPS standard. For example, a case in which a number N of channels is 24 and a number of downmixed N/2 channels is 12 may be expressed to be Table 3. However, referring to Table 3, the OTT modules defined by the MPS standard are not usable.

Thus, when a number of the input channels is more than or equal to 10, the OTT modules may not be used to generate downmixed audio signals of N/2 channels using a conventional MPS encoder. Accordingly, a decoding apparatus may be implemented to bypass the conventional MPS decoder.

To process audio signals corresponding to a channel which is unable to be processed by the conventional MPS decoder, according to an example embodiment, an arbitrary tree coding mode may be applicable as illustrated in FIG. 8. The arbitrary tree coding mode indicates that a tree structure in which an additional OTT module is applied for each channel of an MPS output signal is used.

According to an example embodiment, when a channel number of an input signal exceeds a channel number to be performed by the MPS standard, the decoding apparatus may process the input signal by bypassing a reference block defined by the MPS standard based on a syntax definition such as Table 3, and applying the OTT module to each channel using the arbitrary tree coding mode.

Thus, when the downmix signals corresponding to channels (1 channel, 2 channel, and 5.1 channel) supported by the conventional MPS standard are input to the MPS decoder, the MPS decoder operates based on an MPS standard mode of FIG. 8. However, when downmix signals corresponding to a channel which is not supported by the conventional MPS standard are input to the MPS decoder, the MPS decoder operates based on an N-N/2 operation mode of FIG. 8. That is, when the downmix signals corresponding to the channel which is not supported by the conventional MPS standard are input to the MPS decoder, input audio signals may be processed by bypassing an MPS reference block based on the syntax definition such as Table 3 and adding the OTT module to each channel using the arbitrary tree mode such as the N-N/2 operation mode of FIG. 8. The arbitrary tree is defined by the MPS standard, and the arbitrary tree may be used for processing a channel structure which is not defined by the MPS standard.

When the arbitrary tree is used, processing may be performed as follows. Here, numOTTBoxexAT is defined by Treeconfig( ).

```
ArbitraryTreeData( )
{
  for (i=0; i<numOttBoxesAT; i++) {      Note 1
    EcData(ATD, i, 0, bsOttBandsAT[i]);
  }
}
```

Here, an arbitrary tree data (ATD) parameter is transferred to each OTT box of the arbitrary tree. And dequantization of the ATD parameter is processed by following Equation 1.

$$D_{ATD}^{Q}(\text{atd},l,m)=\text{deq}(\text{idxATD}(\text{atd},l,m),\text{CLD}),\ 0\leq\text{atd}\leq\text{numOTTBoxexAT} \quad \text{[Equation 1]}$$

And, an arbitrary downmix gain parameter is dequantized using a CLD parameter dequantization table according to following Equation 2.

$$G^{Q}(\text{ic},l,m)=\text{deq}(\text{idxCLD}(\text{off}+\text{ic},l,m),\text{CLD}),$$

$$0\leq\text{ic}\leq\text{numInChan, where off}=\text{numOttBoxes}+4\text{numTttBoxes} \quad \text{[Equation 2]}$$

The arbitrary tree includes trees expressed by bsOTTBoxPresent[ch]. For example, whether to express a subtree is determined according to 1 and 0 which are bit strings included in bsOTTBoxPresent[ch]. Here, an OTT box is used when a bit string is 1, and the OTT box is not used when the bit string is 0. A depth in the arbitrary tree is determined according to positions of 0 and 1 included in the bit strings. For example, a first bit string in bsOTTBoxPresent[ch] corresponds to a node of a depth 1, and a second bit string corresponds to a node of a depth 2.

Referring to FIG. 8, in the N-N/2 operation mode, an audio signal corresponding to a vector y is not generated or a result identical to a signal corresponding to a vector x is output. An audio signal corresponding to a final vector Z is output based on a post matrix[M3] operating in the arbitrary tree coding mode. The arbitrary tree may be extended from a structure, such as a predetermined tree 5-2-5 and 7-5-7, so as to output a more number of channels.

The arbitrary tree may be combined with the predetermined tree in the MPS standard mode. A sub-band output signal output from the arbitrary tree is defined as z by all time slots n and all hybrid sub-bands k. In FIG. 8, z may be determined by following Equation 3. M3 is defined in a section 6.5.4 of the MPS standard.

$$z^{n,k}=M_3^{n,k}y^{n,k} \quad \text{[Equation 3]}$$

Figure 9:
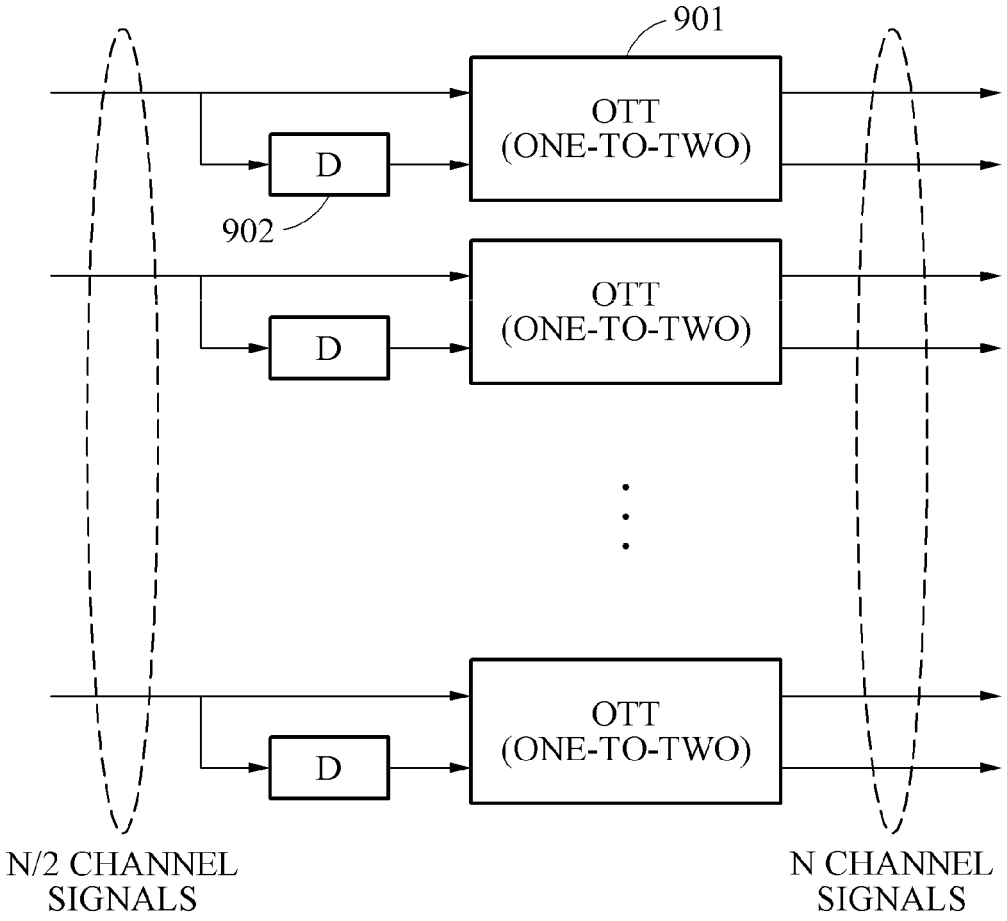
FIG. 9 illustrates a process of upmixing using a decorrelated signal in a second decoding unit according to an example embodiment.

FIG. 9 illustrates a process of upmixing using a decorrelated signal in a second decoding unit according to an example embodiment.

Referring to FIG. 9, a second decoding unit includes a plurality of one-to-two (OTT) modules 901 and a decorrelator 902 corresponding to the plurality of the OTT module 901. Audio signals input to an OTT module are downmix signals indicating audio signals of one channel. Therefore, the OTT modules 901 may output audio signals of two channels using a downmix signal and a decorrelated signal generated using the decorrelator 902 and channel related parameters CLD, ICC, and IPD.

According to an example embodiment, downmix signals, such as audio signals of N/2 channels, are generated in an MPEG Surround (MPS) encoder by downmixing audio signals of N channels corresponding to greater than or equal to 10 channels using the MPS encoder. And downmix signals generated in the MPS encoder using an MPS decoder may be restored to original audio signals of N channels based on an N-N/2 operation mode to which an arbitrary coding mode is applied.

The units described herein may be implemented using hardware components and software components. For example, the hardware components may include microphones, amplifiers, band-pass filters, audio to digital convertors, and processing devices. A processing device may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such a parallel processors.

The software may include a computer program, a piece of code, an instruction, or some combination thereof, to independently or collectively instruct or configure the processing device to operate as desired. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums.

The methods described above can be written as a computer program, a piece of code, an instruction, or some combination thereof, for independently or collectively instructing or configuring the processing device to operate as desired. Software and data may be embodied permanently or temporarily in any type of machine, component, physical or virtual equipment, computer storage medium or device that is capable of providing instructions or data to or being interpreted by the processing device. The software also may be distributed over network coupled computer systems so that the software is stored and executed in a distributed fashion. In particular, the software and data may be stored by one or more non-transitory computer readable recording mediums. The non-transitory computer readable recording medium may include any data storage device that can store data that can be thereafter read by a computer system or processing device. Examples of the non-transitory computer readable recording medium include read-only memory (ROM), random-access memory (RAM), Compact Disc Read-only Memory (CD-ROMs), magnetic tapes, USBs, floppy disks, hard disks, optical recording media (e.g., CD-ROMs, or DVDs), and PC interfaces (e.g., PCI, PCI-express, WiFi, etc.). In addition, functional programs, codes, and code segments for accomplishing the example disclosed herein can be construed by programmers skilled in the art based on the flow diagrams and block diagrams of the figures and their corresponding descriptions as provided herein.

A number of examples have been described above. Nevertheless, it should be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

DESCRIPTION OF THE REFERENCE NUMERALS

100: Encoding apparatus

101: Decoding apparatus

What is claimed is:

1. An encoding method for a multi-channel audio signal, the method comprising:

generating, by a MPS (MPEG Surround) encoder, audio signals of N/2 channels by downmixing audio signals of N channels; and converting, by a sampling rate converter, a sampling rate with respect to an audio signal, performing encoding, by a USAC(Unified Speech and Audio Codec) encoder, with respect to a core band of the audio signals of the N/2 channels, wherein the generating of the audio signals of the N/2 channels comprises:

generating the audio signals of the N/2 channels by downmixing the audio signals of the N channels based on N-N/2-N configuration corresponding to an arbitrary tree coding mode, when N exceeds 10, wherein the converting of the sampling rate comprises converting the sampling rate with respect to the audio signal according to a bit rate to be applied to the USAC encoder.

2. The method of claim 1, wherein the generating of the audio signals of the N/2 channels comprises generating the audio signals of the N/2 channels by downmixing the audio signals of the N channels using N/2 two-to-one (TTO) coding modules.

3. A decoding method for a multi-channel audio signal, the method comprising:

performing, by a USAC(Unified Speech and Audio Codec) decoder, decoding with respect to a core band of audio signals of N/2 channels; and converting, by a sampling rate converter, a sampling rate with respect to an audio signal, generating, by a MPS(MPEG Surround) decoder, audio signals of N channels by upmixing the audio signals of the N/2 channels, wherein the generating of the audio signals of the N channels comprises:

generating the audio signals of the N channels by upmixing the audio signals of the N channels based on N-N/2-N configuration, when N exceeds 10, wherein the converting of the sampling rate comprises converting the sampling rate of the audio signal according to a bit rate to be applied to the USAC decoder.

4. The method of claim 3, wherein the generating of the audio signals of the N channels comprises generating of the audio signals of the N channels by upmixing the audio signals of the N/2 channels using N/2 One-To-Two (OTT) coding modules.

5. A decoding apparatus for a multi-channel audio signal, the apparatus comprising:

a USAC (Unified Speech and Audio Codec) decoder configured to perform decoding with respect to a core band of audio signals of N/2 channels; and a sampling rate converter configured to convert a sampling rate of an audio signal, a MPS (MPEG Surround) decoder configured to generate audio signals of N channels by upmixing the audio signals of the N/2 channels, wherein the MPS decoder is configured to generate the audio signals of the N channels by upmixing the audio signals of the N channels based on N-N/2-N configuration corresponding to an arbitrary tree coding mode, when N exceeds 6, wherein the sampling rate converter converts the sampling rate of the audio signal according to a bit rate to be applied to the USAC decoder.

6. The apparatus of claim 5, wherein the MPS decoder is configured to generate the audio signals of the N channels by upmixing the audio signals of the N/2 channels using N/2 one-to-two (OTT) coding modules.

* * * * *